US006069599A

United States Patent [19]

Py et al.

[11] Patent Number: 6,069,599

[45] Date of Patent: May 30, 2000

[54] FIELD EMISSION DISPLAYS WITH FOCUSING/DEFLECTION GATES

[75] Inventors: Christophe Py, Ottawa; Peter Grant, Metcalfe, both of Canada

[73] Assignee: National Research Council of Canada, Ottawa

[21] Appl. No.: 09/046,698

[22] Filed: Mar. 24, 1998

Related U.S. Application Data

[60] Provisional application No. 60/041,234, Mar. 24, 1997.

[51] Int. Cl.[7] ..... G09G 3/22

[52] U.S. Cl. ..... 345/74

[58] Field of Search ..... 345/74, 75; 313/409, 313/427, 495, 497

[56] References Cited

U.S. PATENT DOCUMENTS 5,721,561 2/1998 Kishino et al. ..... 345/75

*Primary Examiner*—Jeffery Brier

*Attorney, Agent, or Firm*—Marks & Clerk

[57] ABSTRACT

A field-emission display (FED) device has a cathodoluminiescent screen and an emitting assembly for selectively energizing pixels on the screen to form an image. The emitting assembly includes an array of emitters arranged in addressable rows, and controllable focusing/deflection arrangement associated with the respective emitters to permit emissions from the emitters in a group of addressed rows to be simultaneously directed onto a common energized pixel on the screen.

28 Claims, 17 Drawing Sheets

FIELD EMISSION DISPLAYS WITH FOCUSING/DEFLECTION GATES

This application claims priority under 35 USC 119(e) from U.S. provisional application Ser. No. 60/041,234 filed Mar. 24, 1997.

FIELD OF THE INVENTION

The present invention generally relates to field-emission displays (FED), and in particular to field-emission displays with enhanced luminance.

BACKGROUND OF THE INVENTION

The cathode ray tube (CRT) has been around as a display device for many years. Its considerable bulk makes the CRT inconvenient to use, and it has long been a goal to replace it by more convenient flat screen technology. Field-emission displays (FEDs) have shown considerable promise as a flat screen, but they suffer from a problem of low luminance, which makes them impractical to use in situations where there is a high ambient light.

FEDs employ a phosphor screen similar to tile one employed in a CRT. Instead of using a deflected beam from a single electron gun to energize the phosphors, FEDs employ an array of micro field-emitters in close proximity to the screen and all integrated on the same emitting assembly facing the anode. Pixels are defined as elementary points of the anode. The VGA standard, defined by IBM and used in many computer displays, has 480 rows and 640 columns of pixels.

In CRTs and FEDs alike, phosphor and the viewer's eye remanance make pixels appear as continuously bright even though they are bombarded by an electron beam only a small portion of the time. The luminosity of a pixel is proportional to the time during which it is illuminated by an electron beam and to its intensity.

Any color can be obtained as a combination of red, blue and green. Color images in FEDs, as in CRTs, are formed by illuminating red, blue and green sub-pixels independently; the eye blends the three different colors and sees the resulting color only. A sub-pixel is defined as one of the three color components of a pixel: each pixel has at least one red, one blue and one green sub-pixel. Each color corresponds to a different phosphor material. The three types of phosphors can be deposited periodically on the screen in parallel stripes. To keep the same resolution of images as in a monochrome screen, the red, green and blue stripes each have a width of one third of the width of a pixel.

Low luminance is still a problem FEDs have to overcome before they can be used in high ambient lights. A lot of effort is being put towards synthesizing new phosphors with a higher luminous efficiency at low anode voltages [Vecht, Chakovskoi]. The other natural approach is to increase the power delivered to the anode. Integrated focusing structures [Kesling] have been proposed to reduce the typical 15 to 30° half-aperture angle of the beams emitted by the cathode. This allows increasing the anode to cathode distance without losing resolution, and consequently increasing the anode voltage without breakdown. The best solution to keep a relatively high density of emitters is to deposit a second insulating layer and a second gate on top of the extraction gate, with a wider aperture [Py, Itoh]. The second gate, called the focus gate, is biased at a lower voltage than the first one to repel marginal rays. The power delivered to each pixel can be further enhanced by increasing the current.

FIG. 1 shows a typical field-emitter used in FEDs. A microtip 1 made of a suitable emitting material is deposited on a metallic or semi-conducting cathodic layer 100 surrounded by an insulator layer 2 on which a conductive or semi-conductive layer 3, called the extraction gate, is fabricated. Layers 2 and 3 have an aperture over the microtip 1 so that the microtip is exposed to vacuum. Microtip 1, and layers 100, 2 and 3 are deposited on a same substrate (not shown) and form the emitting assembly.

Electrons are extracted from the microtip 1 when a high field is produced at its apex by positively biasing the extraction gate 3 with respect to the microtip 1. The voltage of the microtip 1 is applied through layer 100. The electric field makes the Fermi barrier so thin that electrons can tunnel through, as described by Fowler and Nordheim [R. H. Fowler and L. W. Nordheim, Proc. Roy. Soc. A119, 173 (1928)]. The extracted electrons are emitted into vacuum and follow paths described by Newton's laws of motion and by the electrostatic laws.

A fabrication technique for field emitters is disclosed in U.S. Pat. No. 3,789,471, C. A. Spindt K. R.Shoulders L. N. Heynick and in the article by C. A. Spindt, J.Appl. Phys, vol 39 (1968) p3504. Micro-electronic techniques permit the integration of micron-size tips with extraction gates so close that a fraction of a micro-ampere can be obtained for an extraction gate to microtip voltage less than 100V.

The emission current as a function of that voltage has a diode-like characteristic. For the purposes of the following discussion, it will be assumed that microtips emit at a voltage of 80V (except when a second gate, described as the focusing/deflection gate in the statement of invention, is biased at a high negative voltage), and do not emit when this voltage is reduced to 50V. As shown in FIG. 1, light is obtained by illuminating a phosphor anode 6 with an electron beam from the underlying micro-emitter 1.

Electron field emitters in FEDs are addressed in a XY matrix fashion, as described for example in U.S. Pat. No. 4,857,799 to C. A. Spindt and C. E. Holland. The image is formed by turning on or off the emitters facing each pixel. This eliminates the need for beam-rastering and gives FEDs their flat display characteristics.

As shown in FIG. 2, the FEDs consist of a grid having rows 301, 302, 303 and columns 101, 102, 103. The rows are formed of conductive or semiconductive material containing apertures forming the extraction gates, which are arranged in groups. The columns are formed strips of conductive or semiconductive material supporting the microtips also arranged in groups and in positions corresponding to the groups of apertures formed in the rows. The groups of microtips and corresponding extraction gates lie at the intersections of the rows and columns and define cells, each of which lies under a pixel, such as 601, 603. The designation of rows and columns is arbitrary, and it is not necessary that they be arranged in an orthogonal manner.

As shown in FIG. 3*a*, the emitting assembly is addressed gate row by gate row, and the pixels of the anode are illuminated pixel row by pixel row, a pixel row being defined as a group of pixels arranged in a parallel fashion to the gate rows. The active gate row 302 is biased at +50V, while all the others are at 0V. Cells at the intersection of that gate row and columns 101 and 103 biased at −30V emit electrons towards pixels 601 and 603. All other cells have an extraction gate to microtip voltage difference of 50V, 30V or 0V and do not emit electrons. For the same image frequency, gate row by gate row addressing enables a much longer illumination time for each pixel than the pixel by pixel addressing mode of a CRT. For example, in a VGA FED, each pixel can be illuminated 1/480 of the time rather than 1/(480*640) in a VGA CRT.

FIGS. 3*b* and c are top view of FEDs in the two color addressing modes. In each Figure, the gray gate row is the active one (biased at +50V), whereas other gate rows are grounded. The emitting cells are the intersections of those rows and columns biased at −30V.

In the switched cathode mode of FIG. 3*b*, the columns addressing the microtips are separated in three smaller columns, hereinafter referred to as sub-columns, and the phosphor stripes are parallel to the columns. A sub-cell is defined as the intersection of a gate row and a sub-column. The three sub-pixels of the same pixel can be illuminated at the same time since they are illuminated by sub-cells of the same row. Thus, the time of illumination of a sub-pixel is the same as the time of illumination of a pixel in a monochrome FED. If the red, green and blue phosphors have the same luminous efficiency as phosphors used in monochrome displays, the addressing mode would have the same luminance as a monochrome FED. The emitting assembly is addressed gate row by gate row and the anode is illuminated pixel row by pixel row. The gray row is the addressed row so that electrons can be emitted from their intersection with selected sub-columns. Gate row 312 is biased at +50V and sub-columns 111, 112, 114 and 116 are biased at −30V simultaneously, so sub-cells at the intersection of gate row 312 and those columns emit electrons and sub-pixels 611, 612, 614 and 616 are illuminated. All other sub-cells do not emit.

The phosphor stripes could also be parallel to the rows, but then sub-pixels could not be illuminated simultaneously so the luminance of the screen would be three times lower.

In the switched anode mode shown in FIG. 3*c*, the emitting assembly is the same as in a monochrome display for a same pixel resolution. In order to address each sub-pixel of a same pixel independently, each color stripe of the anode is electrically separated and illuminated sequentially. Color stripes can be arranged parallel to the columns as in FIG. 3*c* or parallel to the rows as in FIG. 3*d*. The color image is formed by sequential formation of the red, green, and blue images. In FIG. 3*c*, when the red image is formed, the red stripes 721, 724 and 727 on the anode are biased at a high voltage whereas green stripes 722, 725 and 728 and blue stripes 723, 726 and 729 are biased at −30V so that electrons cannot reach them.

In FIG. 3*d*, when the red image is formed, the red stripes 733, 736 and 739 on the anode are biased at a high voltage whereas green stripes 732, 735 and 738 and blue stripes 731, 734 and 737 are biased at −30V so that electrons cannot reach them. In both cases, all the red stripes are grouped together, as are the green and blue stripes respectively. The inter-digital system formed is switched only three times during an image formation because the red, green and blue images are formed sequentially.

The emitting assembly is addressed in a gate row by gate row manner, so the anode is still illuminated in a pixel row by pixel row manner, even though only one of the three colors of a pixel is illuminated at a time. The gray row 322 is biased at +50V and columns 121 and 122 are biased at −30V, so the cells at the intersection of gate row 322 and those columns emit.

In FIG. 3*c*, the electrons are directed towards red sub-pixels 621 and 622 which, being part of stripes 722 and 725, are biased at +200V. In FIG. 3*d*, the electrons are directed towards red sub-pixels 631 and 632 which, being part of stripe 736, are biased at +200V.

The advantage of switched anode mode when compared to a monochrome display is that only three connections are necessary for the anode rather than one, but no extra connections are necessary for the cathode. By comparison, the number of column connections in the switched cathode mode is increased by a factor of three. In the switched anode mode, the current received by a sub-pixel is the same as the current received by a pixel in a monochrome screen. Assuming that red, green and blue phosphors have the same luminous efficiency as phosphors used in monochrome displays, this means that this addressing mode would have the same luminance as a monochrome FED.

One disadvantage of the switched anode addressing mode is illustrated in FIG. 4. This simulation corresponds to the case of FIG. 3*d*, but the worst case also applies to the case of FIG. 3*c*. As seen in FIG. 4, a significantly portion of the electrons emitted by the cell at the intersection of gate row 332 and column 131 actually do not reach the sub-pixel 631 but are repelled by neighboring sub-pixels. The current received by the sub-pixel, and the luminosity of the screen, is thus decreased. Lost electrons can reach a sub-pixel of the same color in another pixel and create cross-talk or might return to the extraction gate and damage it.

Beams emitted by microtips have a typical 15 to 30 degree half-angle aperture. Thus, for a given resolution of the screen, the distance from anode to emitting assembly is limited, which in turn limits the anode voltage under the breakdown limit. For this reason, FEDs use phosphors at much lower voltage than cathode ray tubes. Phosphors have a low luminous efficiency at the low anode voltages used in FEDs. Thus the luminance of FEDs can be enhanced by reducing the aperture of the beams emitted by microtips because then the anode to cathode distance can be increased which permits using a higher anode voltage. This can be achieved by integrating focusing electrodes on the cathode in a known fashion [W. D. Kesling and C. E. Hunt, IEEE Trans ED 42(2) p 193–200 (1995)]. In FIG. 5, a microtip 1 made of any emitting material is fabricated on a metallic or semi-conducting layer 100 surrounded by an insulator layer 2 on which a conductive or semi-conductive layer 3 is deposited. On top of extraction gate 3, a second insulating layer 4 and a second gate 5, hereafter referred to as a focus gate, are added. Focus gate 5 can be made of any metallic or semi-conductive material. Insulating layer 4 and focus gate 5 have openings substantially facing the opening in extraction gate 3 and insulating layer 2. Focus gate 5 is biased at a lower voltage than extraction gate 2 so that marginal rays are repelled towards the normal to the plane of the cathode, and the aperture of the beam is significantly reduced.

A. Hoeberechts G. VanGorkom introduced the concept of integrating deflection electrodes to an emitting assembly [EP0184868 A. Hoeberechts G. VanGorkom]. One or several electrodes, made of a conductive or semi-conductive material, are integrated substantially in the same plane as the extraction gate and electrically disconnected from it. These electrodes are referred to as deflection gates. In FIG. 6, microtips 1 are fabricated on a metallic or semi-conductive layer 100 and surrounded by an insulator 2 and an extraction gate 342. On each side of extraction gate 342, two electrodes 341 and 343, hereafter referred to as deflection gate, are fabricated substantially in the same plane as extraction gate 342. By biasing the left deflecting gate 341 at a voltage lower than that of the extraction gate 342 and the right deflection gate 343 at a voltage higher than that of the extraction gate 342, the beam emitted by the microtips of the row is deflected towards the right side of anode 6.

An object of the invention is to enhance the luminance of field emission displays.

SUMMARY OF THE INVENTION

According to a first aspect of the present invention there is provided a field-emission display (FED) device comprising a cathodoluminescent screen and an emitting assembly for selectively energizing pixels on said screen to form an image, said emitting assembly comprising an array of emitters arranged in separately addressable rows; and controllable director means associated with said respective emitters to enable emissions from said emitters in a group of separately addressable addressed rows to be simultaneously directed onto a common energized pixel on said screen.

In another aspect of the invention, there is provided a method of displaying an image using a field-emission display (FED) having in array of emitters arranged in separately addressable rows for energizing pixels on a screen forming an anode, and controllable director means associated with the respective emitters, the method comprising the steps of simultaneously addressing a group of separately addressable rows of emitters and activating selected emitters in an addressed group of rows to cause emissions therefrom; and controlling said director means associated with said activated emitters to cause the emissions therefrom to be directed toward common pixels associated with said group of addressed rows.

The director can be in the form of an additional combined focusing/deflection means or in one embodiment it can be provided by extraction gates of the emitters. Suitable negative voltages are applied to the extraction gates of several separately addressable rows in order to direct the emissions onto the energized pixel.

The voltage applied to the focusing/deflection means can be such as to direct emission to an area of the anode representing a pixel from an area of the emitting assembly which is considerably larger than the area of the emitting assembly normally corresponding to a pixel, thus achieving an increased current density on the anode without incurring increased current density from the emitting assembly.

Calculations have shown that combined focusing and deflection can more than double the current received by a pixel.

The invention requires a greater number of rows than the prior art because the row pitch is three times greater. Also, connections are needed for the focus means. However, especially for small or high-resolution screens, the addressing electronics of FEDs will eventually be integrated on the same substrate as the emitters, which will suppress all connection problems.

BRIEF DESCRIPTION OF THE DRAWINGS

FIG. 9*a* shows a first embodiment of the invention in a monochrome display.

FIG. 9*b* shows a second embodiment of the invention in a color display addressed in the switched cathode mode, FIG. 9*c* shows a third embodiment of the invention in a color display addressed in the switched anode mode with color stripes arranged parallel to columns, FIG. 9*d* shows a fourth embodiment of the invention in a color display addressed in the switched anode mode with color stripes arranged parallel to gate rows;

DESCRIPTION OF PREFERRED EMBODIMENTS

Figure 7A:
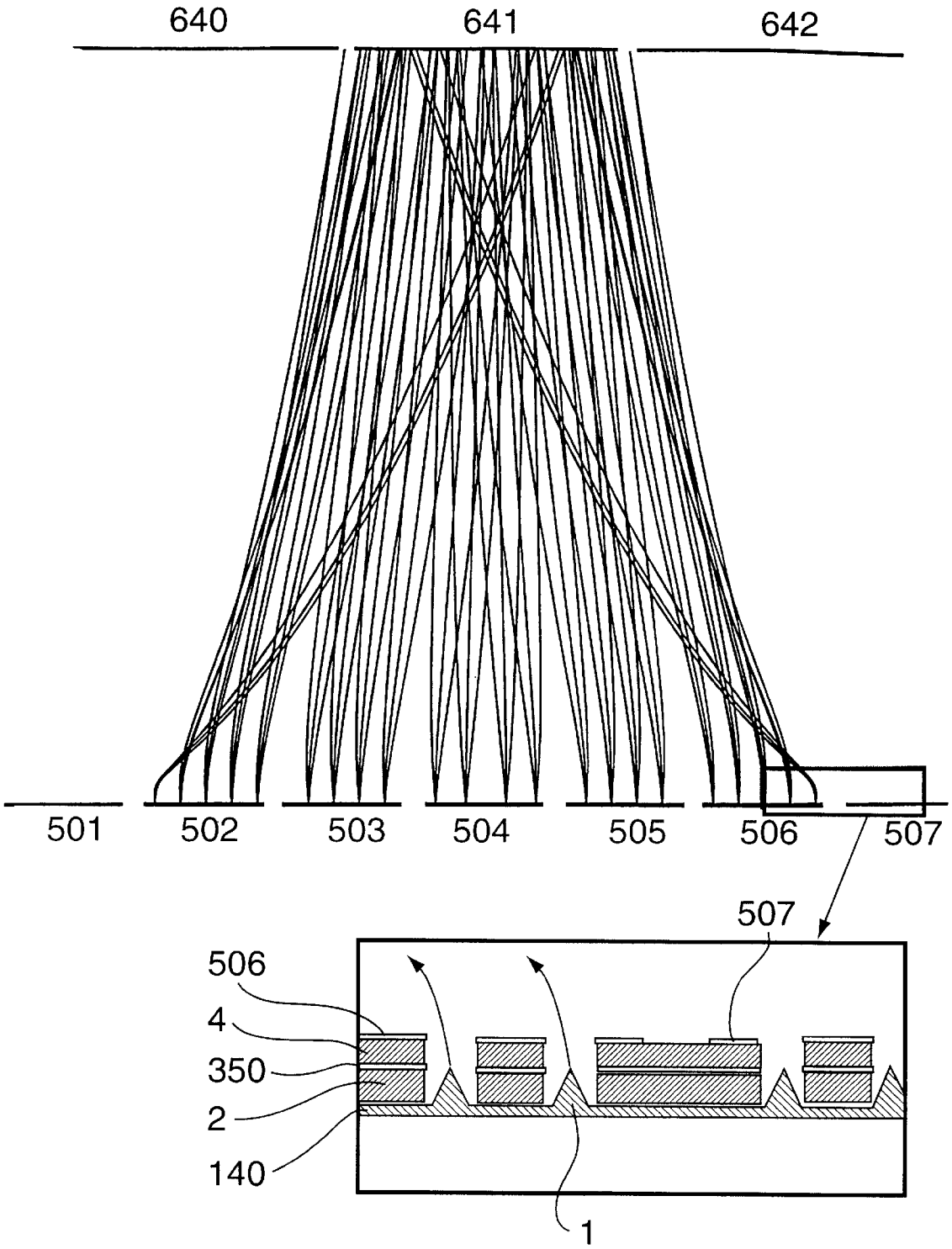
FIGS. 7*a* and 7*b* are side-elevation cross-sections in a plane parallel to columns, showing a simulation of simultaneous focus and deflection of the beams emitted by five sub-cells towards the same pixel or sub-pixel in accordance with the principles of the invention and corresponding to the three embodiments of the invention described in FIGS. 9*a*–9*d*, the cross section being taken along the line B—B in FIGS. 9*a*, 9*b* and 9*c*.
Figure 7B:
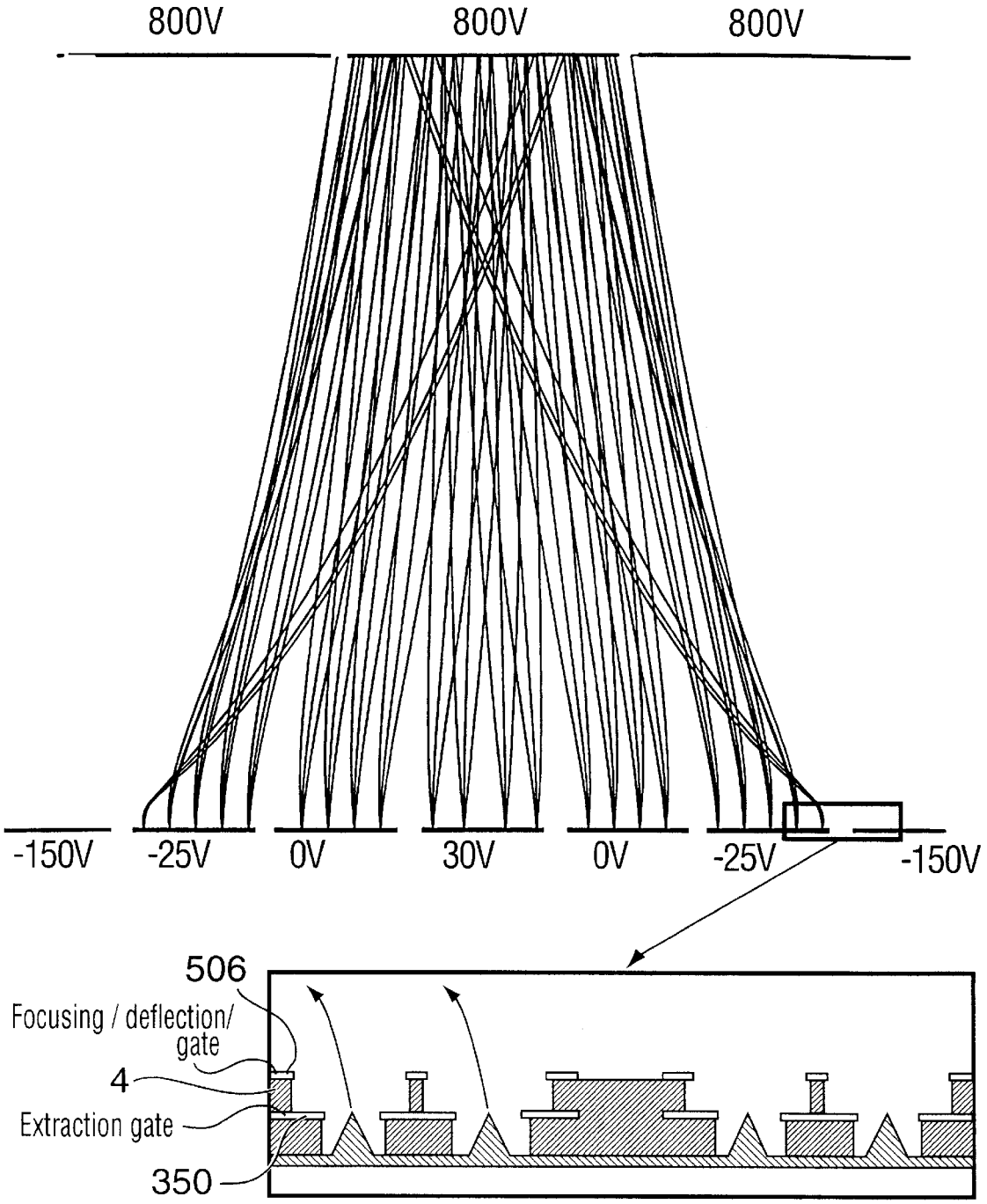

Referring now to FIG. 7*a*, which is a generic description of the three first embodiments shown in more detail in FIGS. 9*a*–*d*, microtips 1 made of a suitable emitting material are fabricated on a metallic or semi-conducting layer 100 and surrounded by an insulator layer 2 on which the extraction gate 350 is deposited. The extraction gate 350 and the insulating layer 2 have apertures exposing each of the microtips 1. On top of the extraction gate 350 are a second insulating layer 4 and a second conductive or semi-conductive layer 506, both with apertures aligned with the apertures in the extraction gate and the first insulating layer. These apertures can have substantially the same size as the aperture in the first insulating layer 2 and the extraction gate 350, or be larger as shown in FIG. 7*b*. The layers 4 and 506 form a second gate will hereafter be referred to as the focusing/deflection gate. Microtips 1 are grouped in a column or sub-column 140 parallel to the section plane of FIG. 7*a*. Focusing/deflection gates are arranged in gate rows 501 to 507 orthogonal to column 140.

Unlike the prior art arrangement, there is no longer a one to one correspondence between the gate rows and the pixel rows. Each pixel is energized by a group of separately addressable gate rows, some of which lie directly under and some of which lie to the side of the active pixel. The gate rows are energized in such a way that the emitted beams from all the active emitters are focused onto the currently energized pixels. The same gate row can be used to energize more than one pixel by changing the deflection voltage. For example, in FIG. 7*a*, emitters 502 to 506 are energized in such a way that their beams are focused onto the pixel 641. It will be noted that emitters 502 and 506 actually lie under the adjacent pixels 640, 642. By changing the deflection voltages their beams can be made to contribute to the energization of these pixels. The rows are thus progressively addressed in overlapping groups to address corresponding rows of pixels on the screen.

In order to illuminate pixel or sub-pixel 641 with emitters 502 to 506, the following voltages are applied: −30V to column 140, +50V to extraction gate 350, and for the focusing-deflection gates: −150V for 501, −25V for 502, 0V for 503, 30V for 504, 0V for 505, −25V for 506 and −150V for 507. Focusing/deflection gate rows at the left of 501 and at the right at 507 are kept at −150V. These voltages are shown in FIG. 7*b*, which also shows a focusing/deflection layer 4 having apertures larger than those in the gate layer 350.

In FIG. 7*b*, the three represented electrodes of the anode are uniformly biased at +800V. All microtips are connected through their base and biased at −30V. The gates define seven arrays. The extraction gate voltage of the five central arrays is +50V, which is a conservative value for field-emission to occur from the microtips. The extraction gates of the two peripheral arrays are negative so microtips don't emit. The voltages of the focus gates are chosen to create a lateral field that deflects electron trajectories towards the central electrode on the anode. At the same time, the second gate in each of the emitting arrays has a focusing effect since its voltage is lower than that of the extraction gate. This effect is not as important for the central array as for the peripheral one, but it is enough to keep the trajectories within the central anode electrode.

As can be seen in FIG. 7*b*, this simultaneous focusing and deflecting effect of the second gates enables concentrating the beams emitted from the five central arrays in a portion of the anode that is narrower.

Microtips at the intersection of column 140 and all gate rows left of 501 (including 501) and right of 507 (including 507) do not. Cells or sub-cells at the intersection of column or sub-column 140 and gate rows 502 to 506 emit due to the field between the microtips and the extraction gate 350.

Electrons emitted are first focused by the field produced by the repulsing field of the focusing/deflection gate surrounding the microtip) they are emitted from. Then they are deflected by the lateral field produced by the different voltages of the focusing/deflection gate rows. The focusing and the deflection effects depend on the place of the emitter with respect to the pixel or sub-pixel. The electrons emitted from an emitter directly facing the pixel or sub-pixel are not deflected as much as the electrons emitted from emitters not directly facing the pixel or sub-pixel.

The emitting assembly is not addressed in a gate row by gate row manner as in the previous art. Rather, several separately addressable rows are addressed at the same time and the beams emitted by the cells or sub-cells at the intersection of those rows and the selected columns or sub-columns are focused and deflected towards the desired pixels or sub-pixels. As a result, the anode is still addressed pixel row by pixel row, but each pixel row is illuminated by several gate rows, and each gate row is used to illuminate two neighboring pixel rows in sequence.

Figure 8:
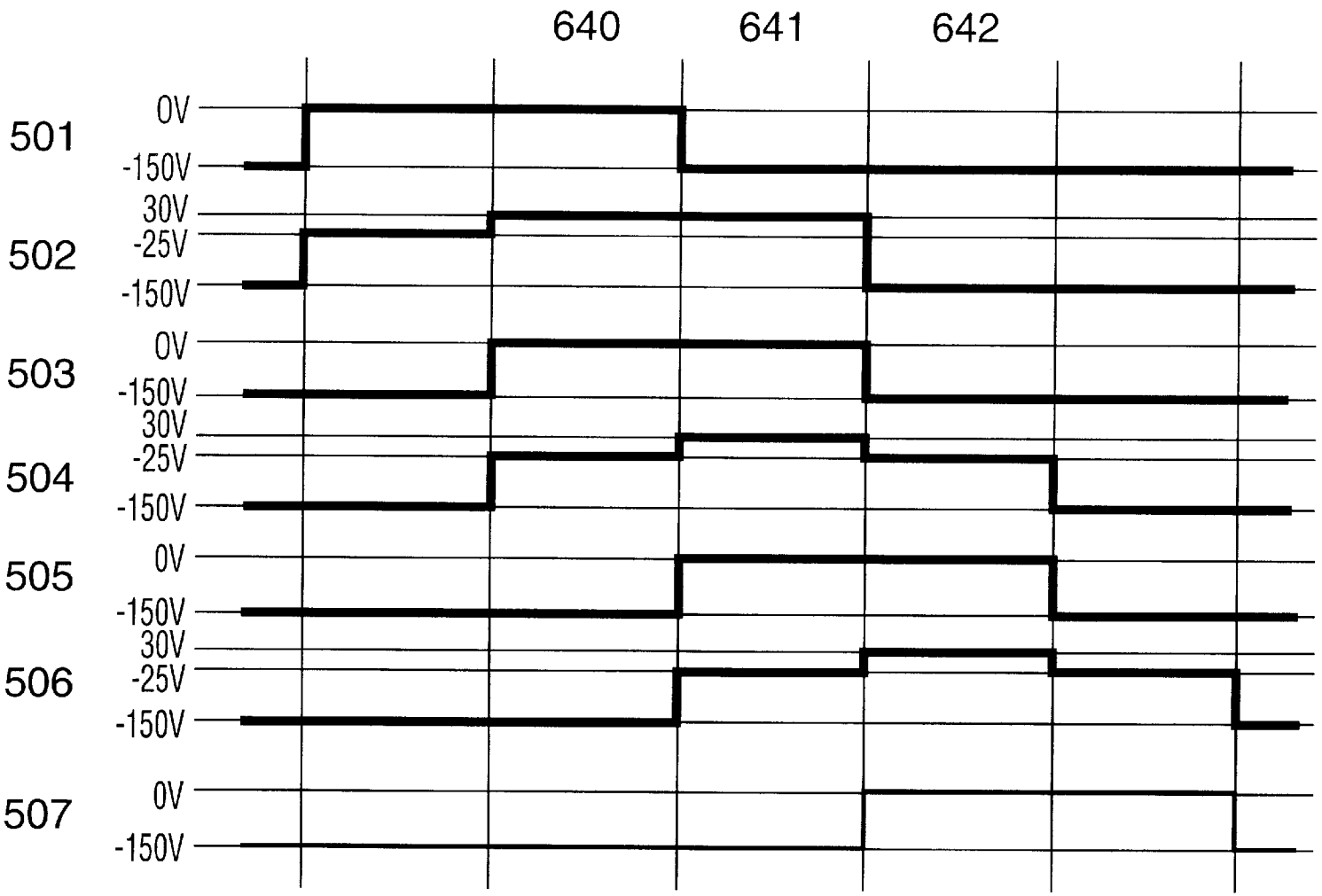
FIG. 8 is a wave-form of voltages applied to rows of the focus/deflection gate as described in FIG. 7.

FIG. 8 shows voltage wave-forms and switching sequence for gate rows 501 to 507 as a function of time. The unit of time is the time during which a pixel row is illuminated. Every second row goes through the same sequence with a pixel row addressing time delay.

During the illumination time of row 641, focusing/deflection gate row 501 is biased at −150V, 502 at −25V, 503 at 0V, 504 at +30V, 505 at 0V, 506 at −25V and 507 at −150V. During the illumination time of 642, row 501 is kept at −150V, 502 and 503 go to −150V, 504 goes to −25V, 505 stays at 0V, 506 goes to +30V and 507 to 0V. The voltage of other rows at the right of 507 will be modified to contribute to the illumination of 642 and/or deflect electrons towards 640.

FIGS. 9*a–d* show three embodiments of the invention that correspond to the three addressing mode of the previous art. The rows in gray are those addressed so that electrons can be emitted from their intersection with selected columns or sub-columns. The simulation of FIG. 7*a* and the wave-form of FIG. 8 are valid for those three embodiments.

Figure 9A:
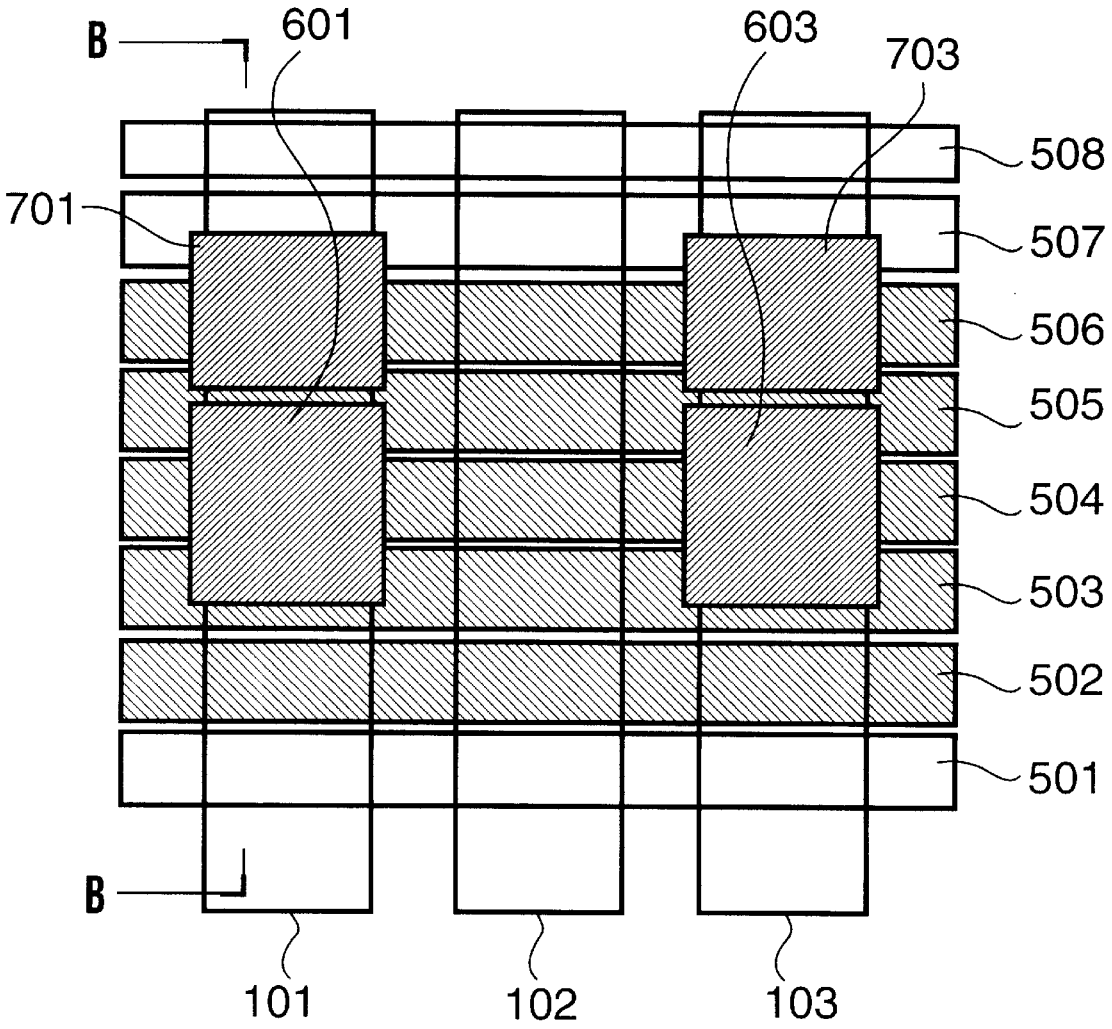
FIGS. 9*a*–9*d* are top views of four embodiments of the invention corresponding to the three known addressing modes described in FIG. 3, wherein, in particular.

It will be noted from FIGS. 7*a* and 9*a*, for example, that the outer pairs of rows 505, 506, and 502, 503 are shared (but not of course simultaneously) with the adjacent pixels 642 and 640 respectively. For example, when pixel 642 is energized, rows 505, 506 are the leftmost outer pair of rows energizing pixel 642, row 507 forms the middle row and so on. Thus, in this embodiment, the extraction gates for pairs of rows 502, 503; 505, 506; etc. will always be energized together. As a result these pairs of adjacent rows can be energized by respective common connections. As a result the total number of connections required by the device can be reduced.

The first embodiment described in FIG. 9*a* is for a monochrome display. FIG. 7*a* corresponds to the embodiment of FIG. 9*a* by identifying 140 in FIG. 7*a* to column 101 in FIG. 9*a* and 641 in FIG. 7*a* to pixel 601 in FIG. 9*a*. In order to address the next row of pixels, 701, 703, rows 504 to 508 would be addressed, but with different deflection voltages applied so as to direct the electron beams onto pixels 701, 703.

Figure 1:
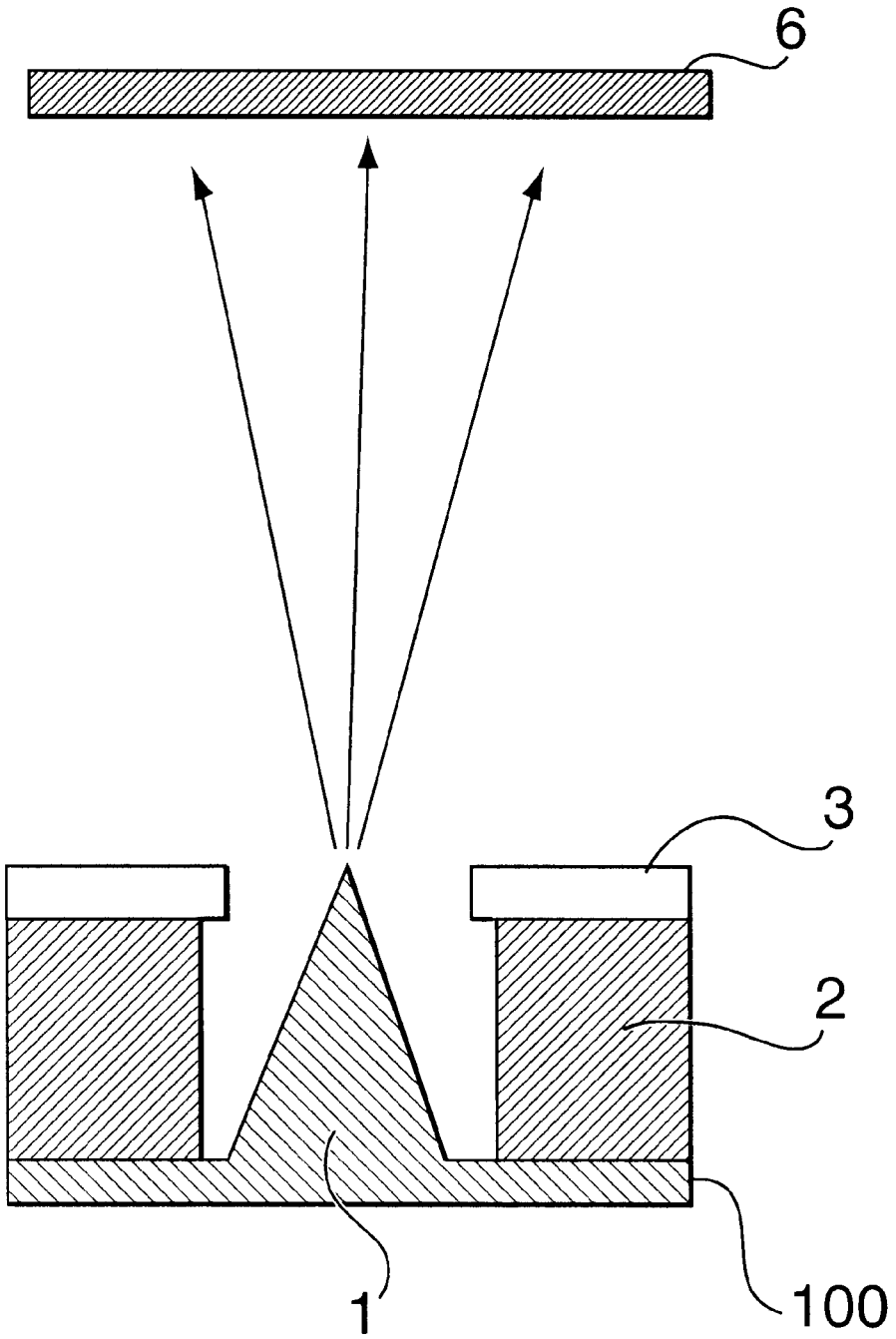
FIG. 1 PRIOR ART
FIG. 1 is a side-elevation cross-section of a field-effect microtip with an extraction gate and an anode as known in the previous art.
Figure 2:
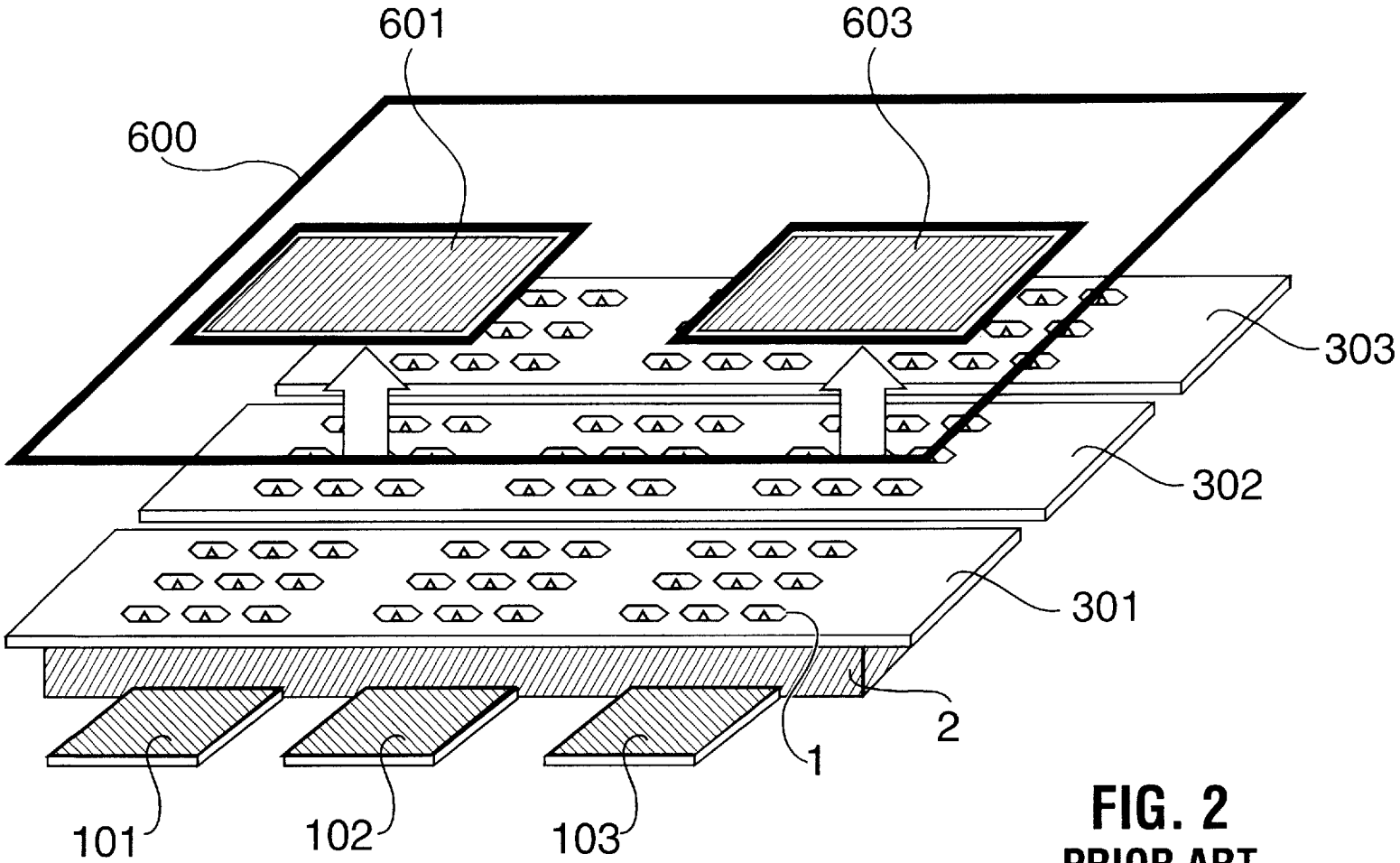
FIG. 2 PRIOR ART
FIG. 2 is a perspective view of a portion of an XY matrix addressed monochrome FED, known in the prior art.
Figure 3A:
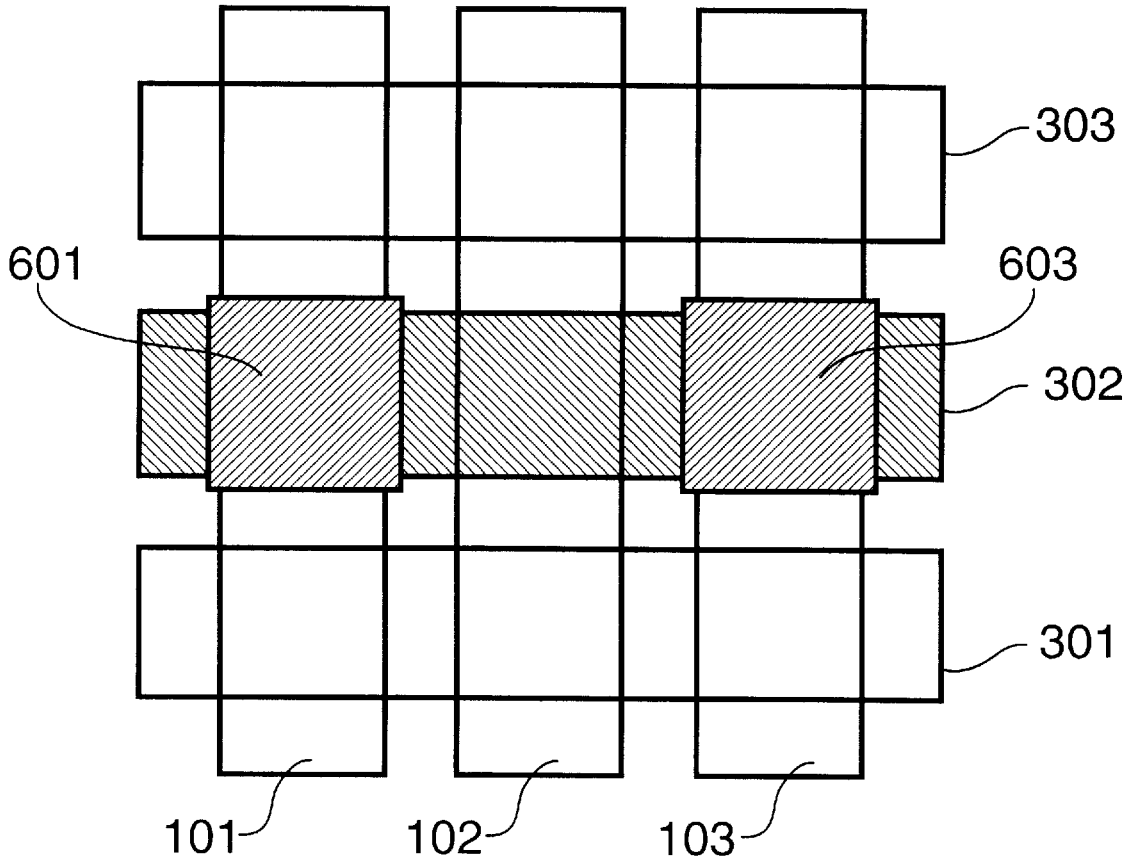
FIG. 3a PRIOR ART
FIGS. 3*a* shows a portion of a prior art monochrome FED.
Figure 3B:
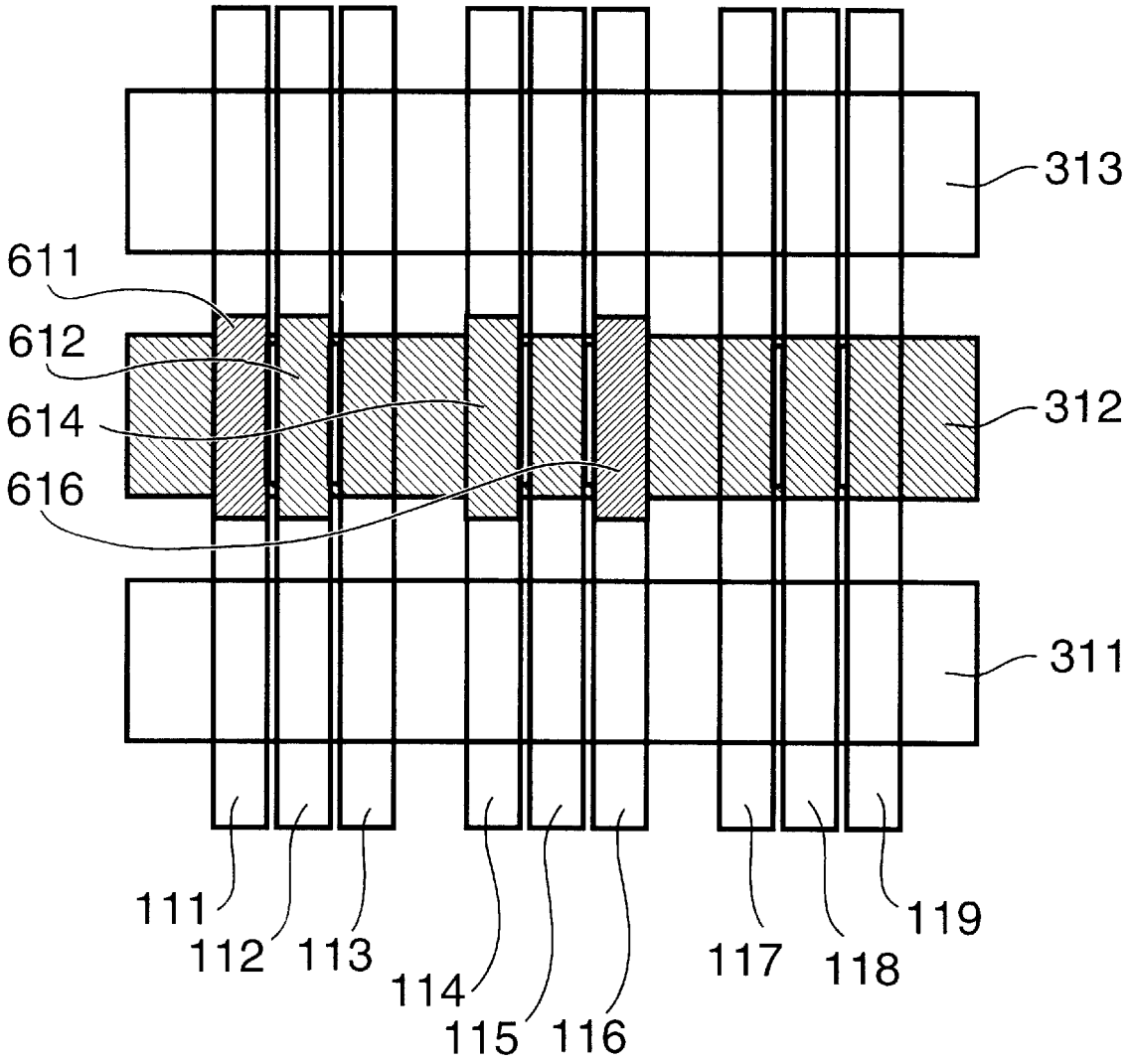
FIG. 3b PRIOR ART
FIG. 3*b* shows a portion of a prior art color FED addressed in the switched cathode mode.
Figure 3C:
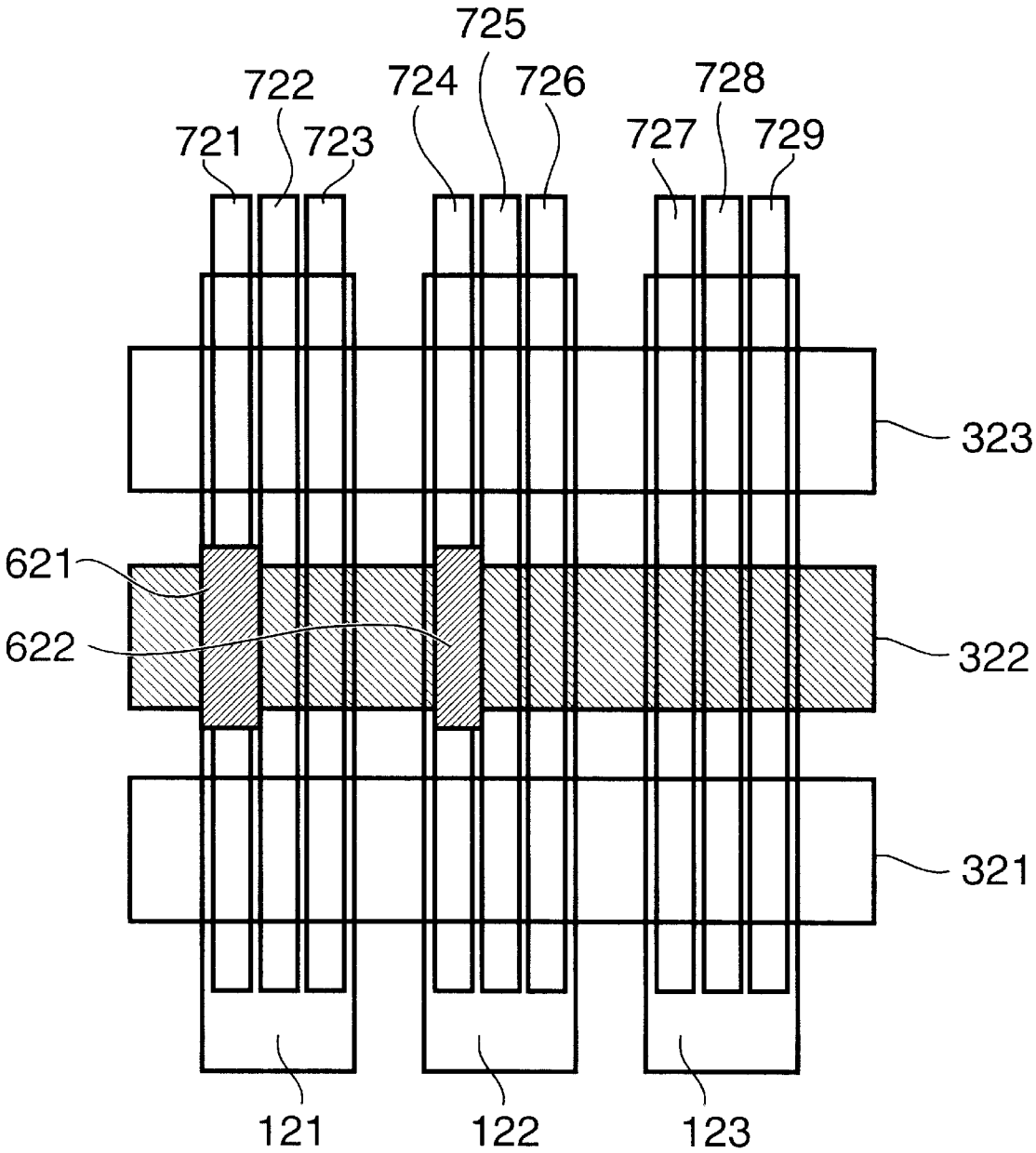
FIG.3c PRIOR ART
FIG. 3*c* is a portion of a prior art color FED addressed in the switched anode mode with color stripes arranged parallel to columns.
Figure 9B:
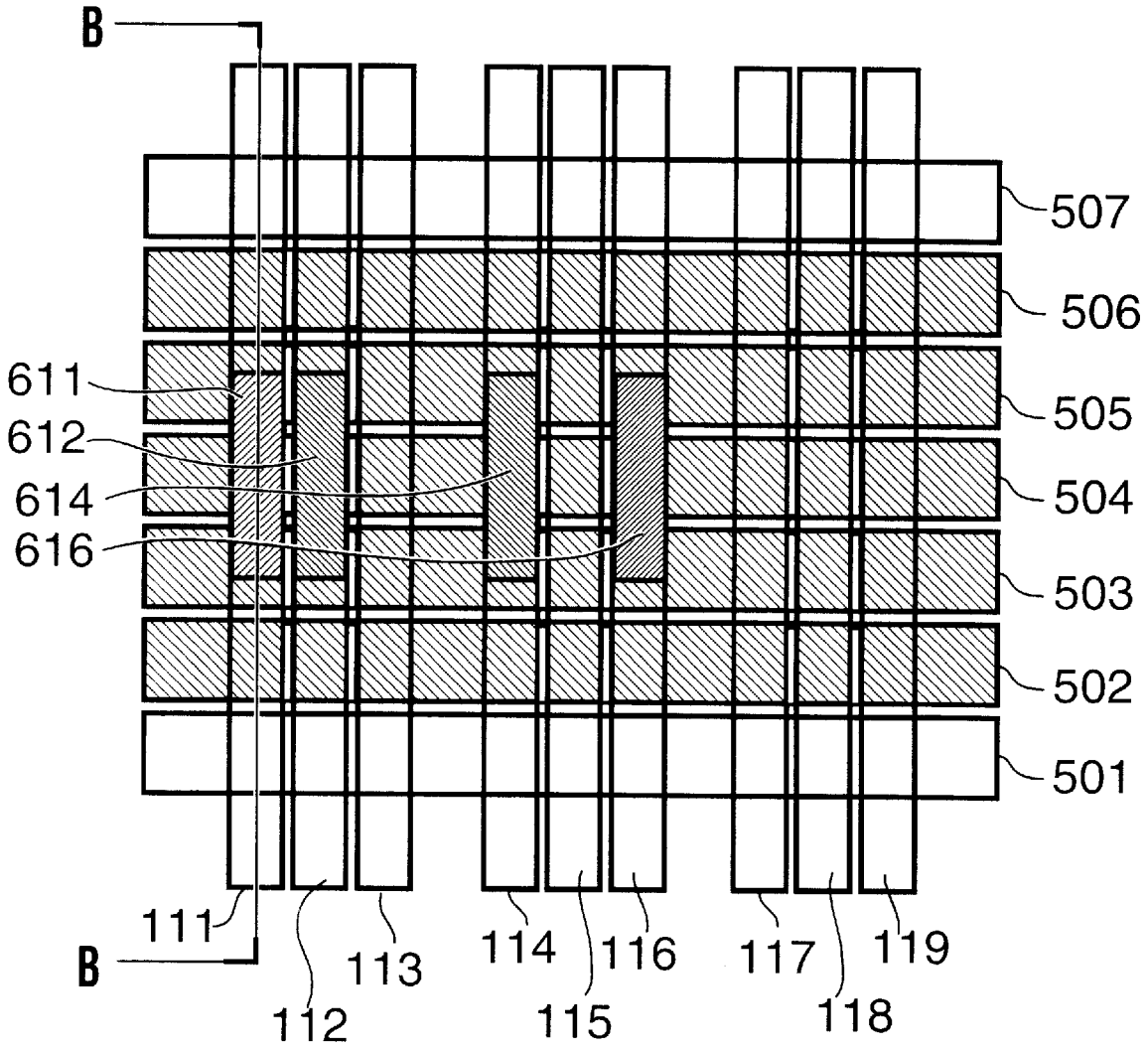

The second embodiment is described in FIG. 9*b* for a color display addressed in the switched cathode mode. FIG. 7 simulates the embodiment of FIG. 9*b* by identifying 140 in FIG. 7 with sub-column 111 in FIG. 9*b* and 641 in FIG. 7 with sub-pixel 611 in FIG. 9*b*. Each row of the groups 111, 112, 113; 114, 115, 116; 117, 118, 119 corresponds to a primary color in a similar manner to the arrangement shown in FIG. 3*b*, but unlike the prior the sub-pixels are addressed by gate rows 502 to 506 extending on either side of the sub-pixel groups.

Figure 9C:
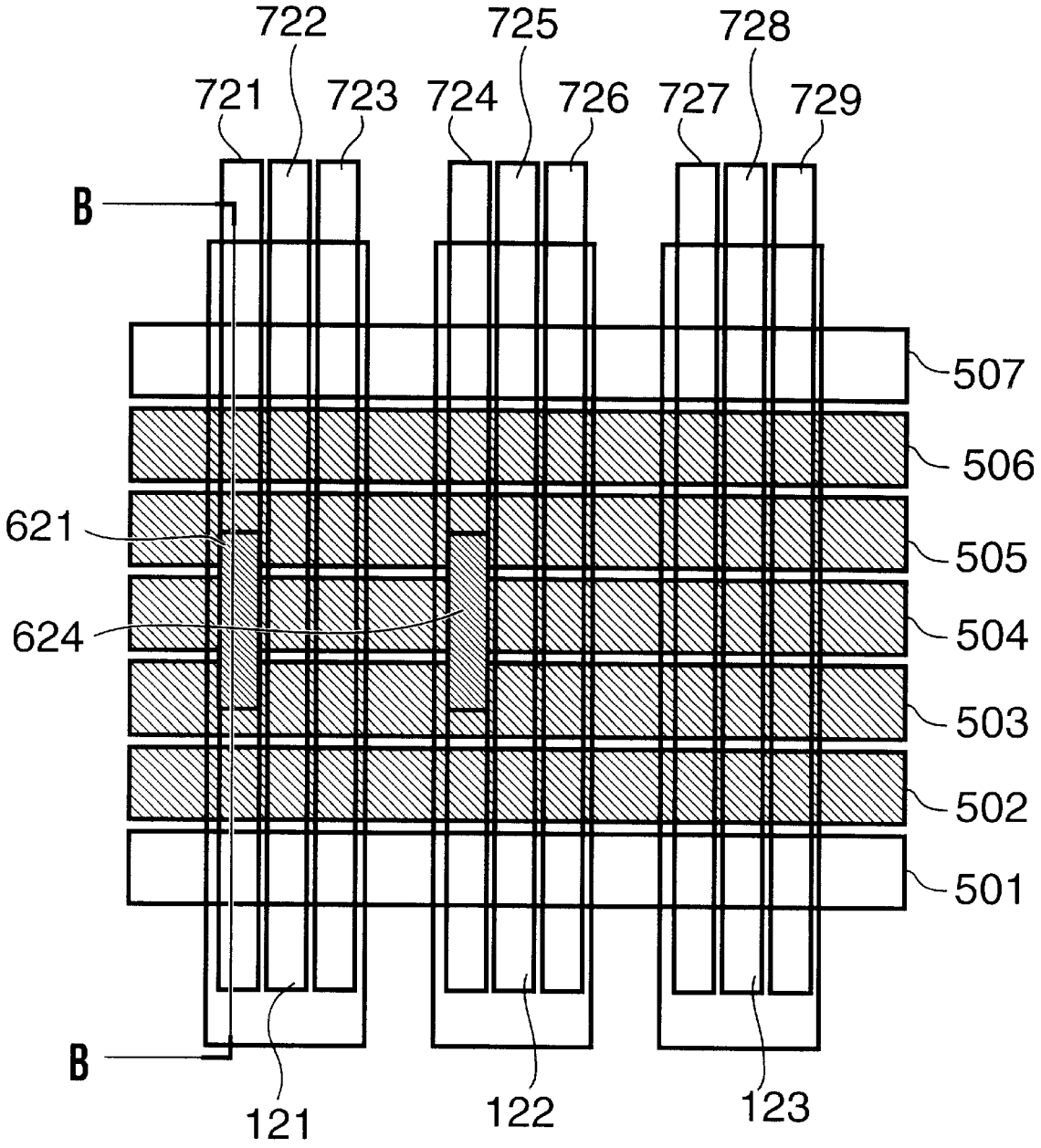

The third embodiment is described in FIG. 9*c* for a color display addressed in the switched anode mode with color stripes arranged parallel to columns. FIG. 7 corresponds to the embodiment of FIG. 9*c* by identifying 140 in FIG. 7 with column 121 in FIG. 9*a* and 641 in FIG. 7 with sub-pixel 621 in FIG. 9*a*.

One advantage of the invention will be apparent by comparing FIG. 9*a* to 3*a*, 9*b* to 3*b* and 9*c* to 3*c*, respectively: in those three addressing modes, the invention enables the surface area of the emitting assembly from which a same pixel or sub-pixel is illuminated to be increased. Thus, regardless of the emitter density in the emitting assembly and the current emitted by each emitter, the invention enables the current received by each pixel or sub-pixel to be increased. In the three particular embodiments described in FIGS. 9*a, b* and *c*, the beam current is approximately doubled.

Figure 4:
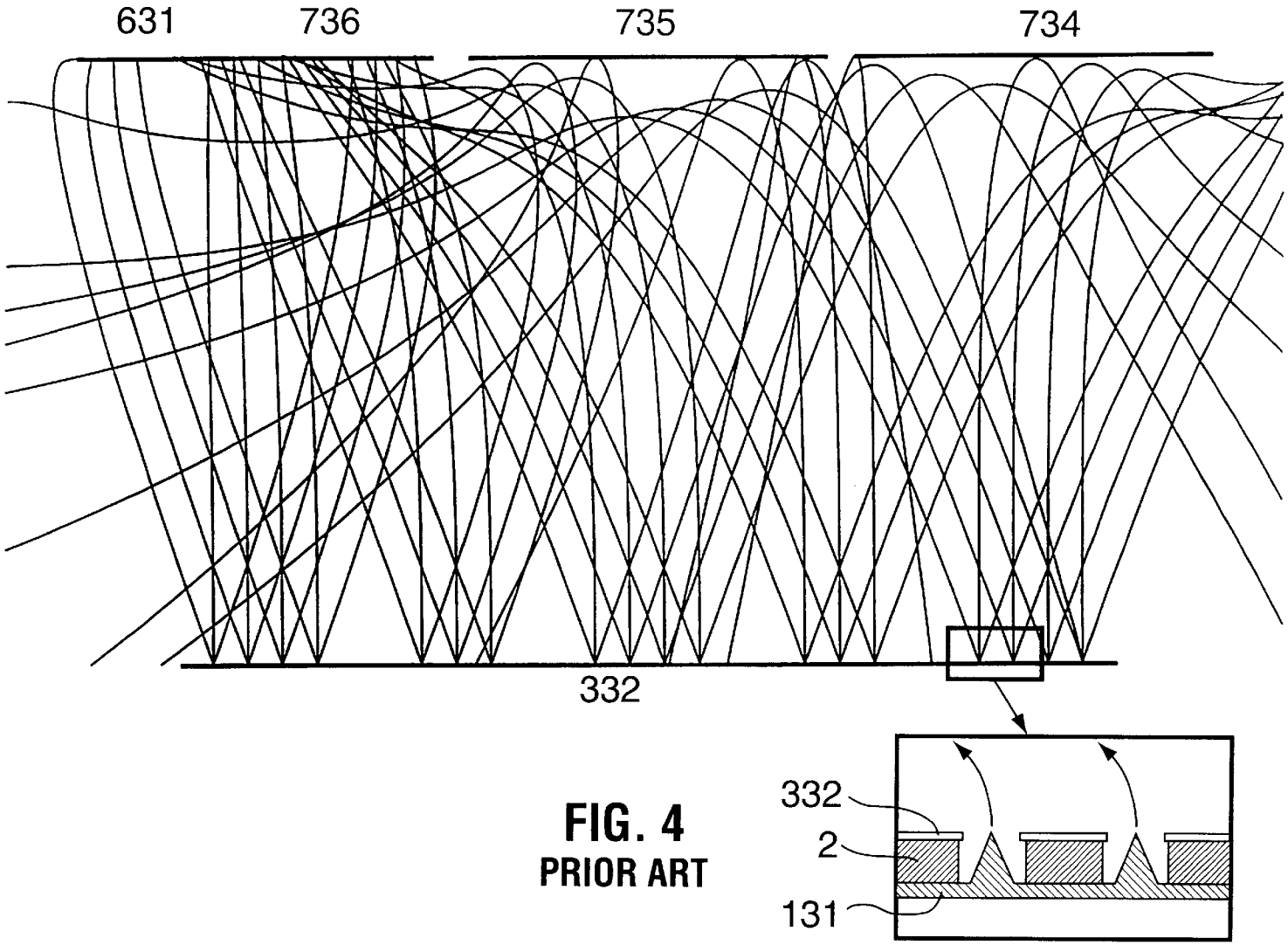
FIG. 4 PRIOR ART
FIG. 4 is a side-elevation cross-section taken along the line A—A as shown in FIG. 3*d* in a plane parallel to columns of a worst case simulation of the prior art carried out by the inventors of a side sub-pixel illuminated by a cell in the known switched anode mode.
Figure 5:
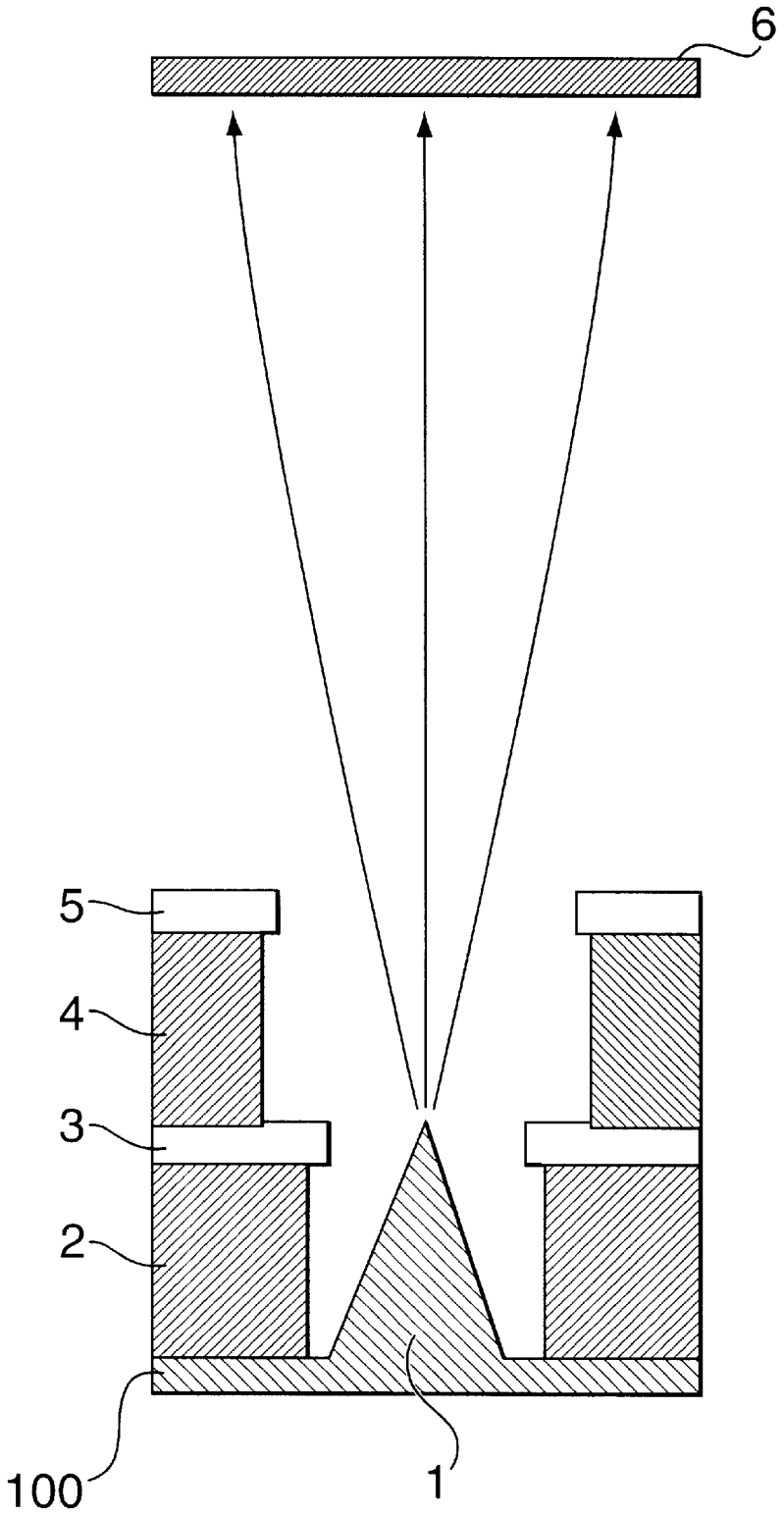
FIG. 5 PRIOR ART
FIG. 5 is a side-elevation cross-section of an emitting assembly with a double-gate emitter enabling integrated focusing, and an anode, known in the prior art.
Figure 6:
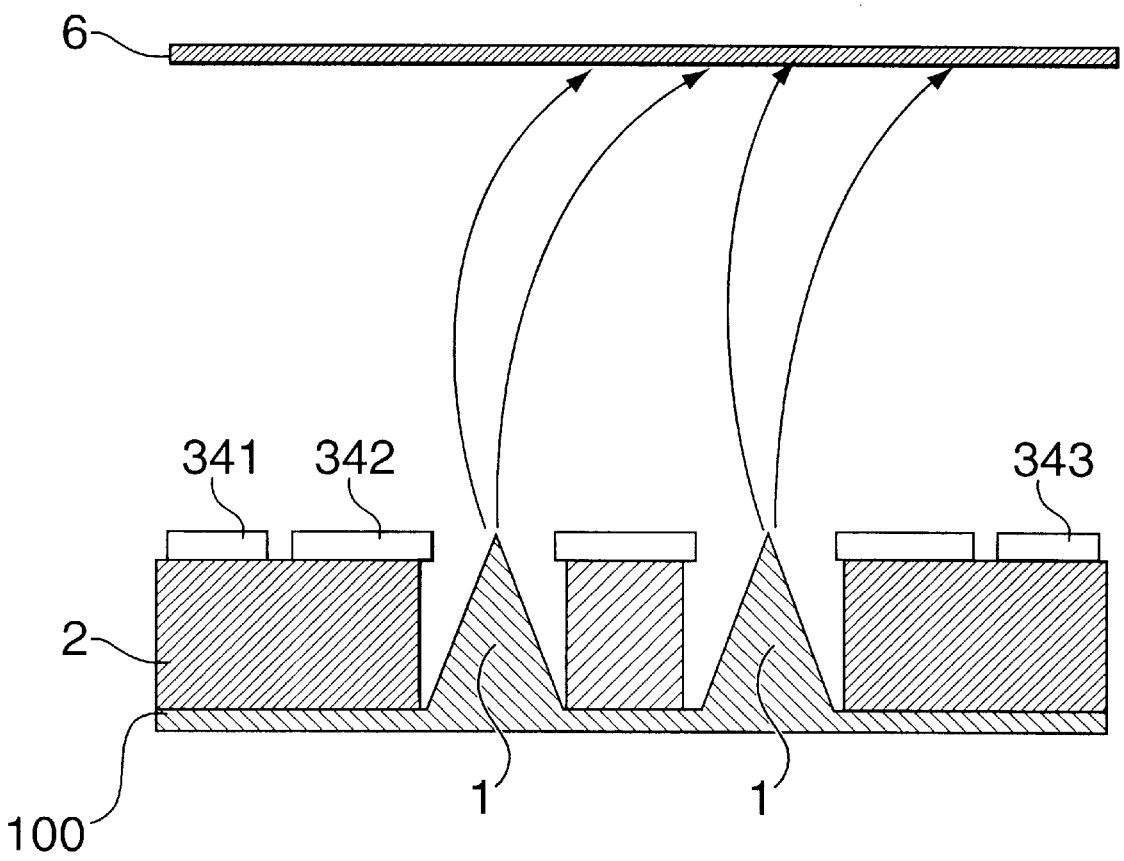
FIG. 6 PRIOR ART
FIG. 6 is a side-elevation cross-section of an emitting assembly with integrated deflection electrodes, and an anode, known in the prior art.
Figure 9D:
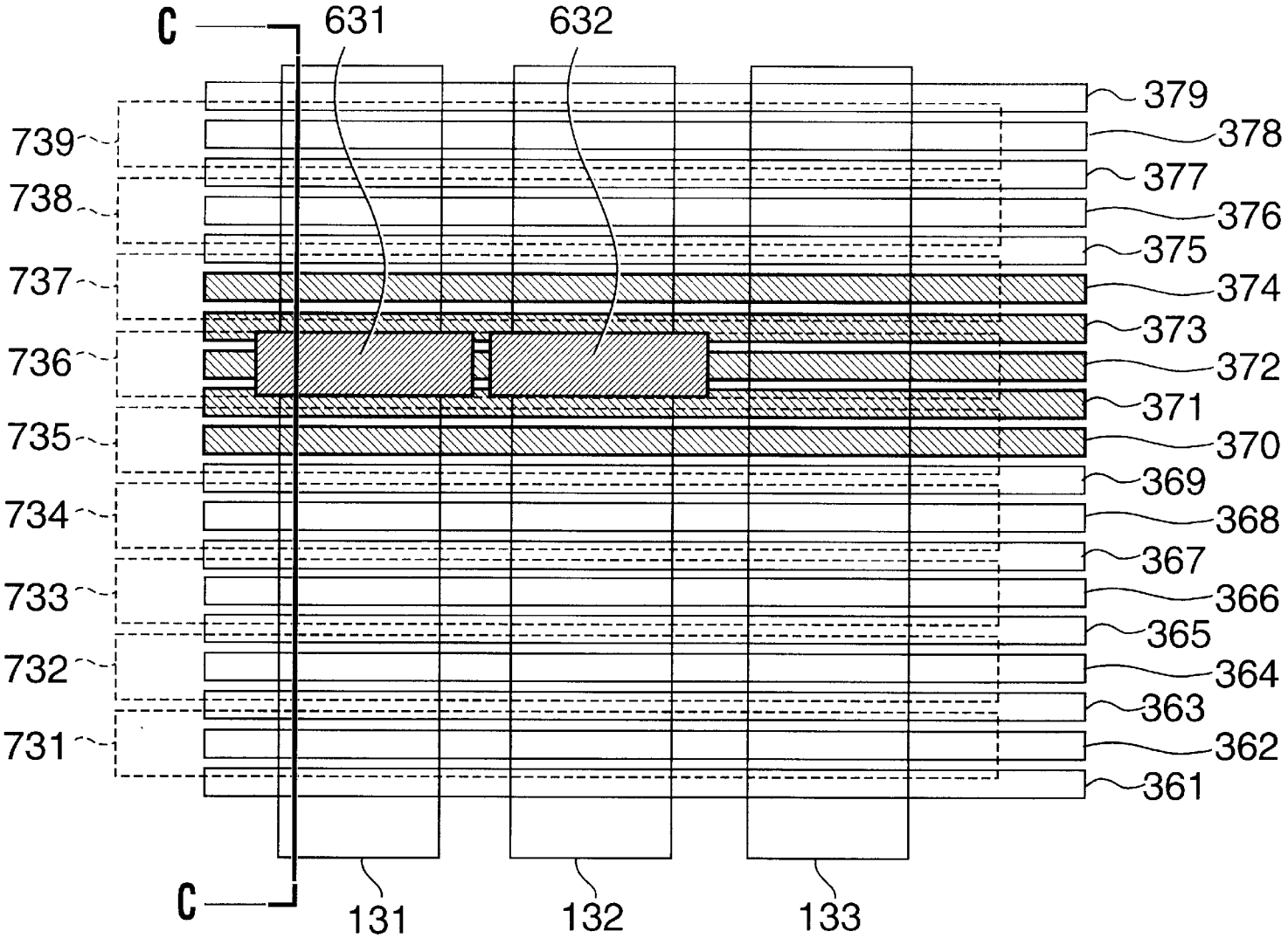
Figure 10:
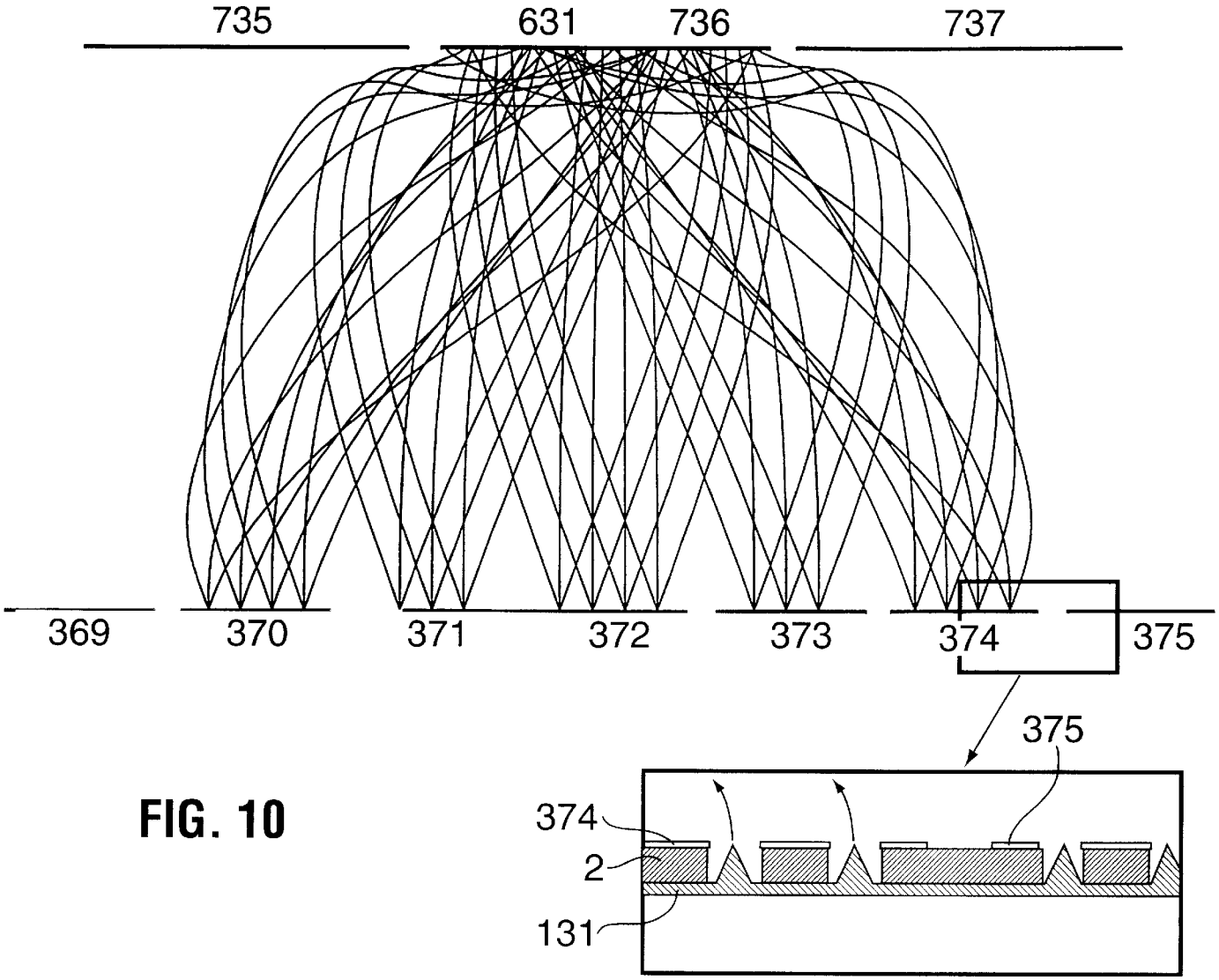
FIG. 10 is a side-elevation cross-section taken along the line C—C as shown in FIG. 9*d* in a plane parallel to columns of a fourth embodiment of the invention in the switched anode mode.

A fourth embodiment of the invention , which is shown in FIGS. 9*d* and 10, eliminates a disadvantage of the prior art that is described in FIG. 4.

Microtips made of any emitting material are surrounded by an insulating layer on which the extraction gate is deposited. The extraction gate and the insulating layer have holes facing the microtip. Microtips are arranged in columns 131 to 133 and extraction gates in rows 361 to 79 transverse to the columns, referred to as gate rows. FIG. 10 is a cross-section of the same embodiment along the plane C—C of FIG. 9*d* and limited to rows 369 to 375, simulating electron trajectories.

In order to illuminate sub-pixel 631, the follow in voltages are applied: −30V to column 131, +50V to gate rows 370 to 374 , −80V to rows 369 and 375, 0V to all other rows of the screen including 361 to 368 and 376 to 379. The anode is addressed as in the prior art described in FIG. 3*d* which means that red stripes 733, 736 and 739 on the anode are biased at a high voltage whereas green stripes 732, 735 and 738 and blue stripes 731, 734 and 737 are biased at −30V so that electrons, can't reach them. Cells at the intersection of 13 and rows 370 to 374 emit due to the field between the microtips and the extraction gate. The deflection effect produced by the rows biased at −80V depends on the place of the emitter with respect to the pixel: the electrons emitted from an emitter directly facing the pixel are not deflected as much as the electrons emitted from emitters not directly facing the pixel.

The emitting assembly is not addressed in a gate row by gate row manner as in the prior art. Rather, several rows are addressed at the same time and the beams emitted by the emitters at the intersection of those rows and the selected columns are deflected towards the desired sub-pixels. As a result, the anode is still addressed pixel row by pixel row, and each pixel row is illuminated by several gate rows. As is apparent from FIG. 9*d*, the same gate row can be used to illuminate the sub-pixels of two different pixel rows.

Figure 3D:
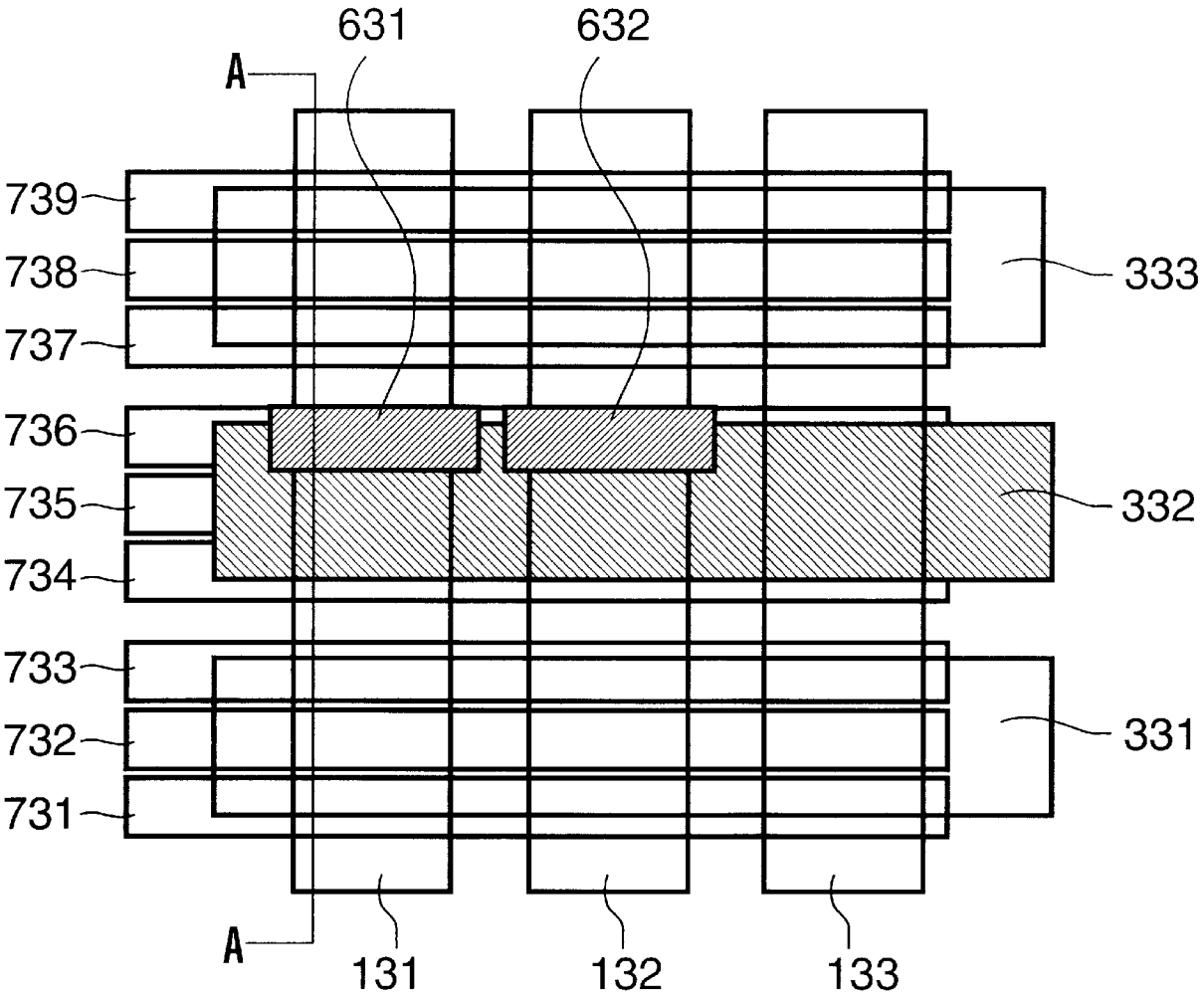
FIG. 3d PRIOR ART
FIG. 3*d* a portion of a prior art color FED addressed in the switched anode mode with color stripes arranged parallel to gate rows.

By comparing the gray areas of FIGS. 3*d* and 9*d*, two advantages of the invention are apparent:

1. The surface of the emitting assembly from which a sub-pixel is illuminated is increased. Thus, whatever the emitter density in the emitting assembly and whatever the current emitted by each emitter, the invention enables the current received by each pixel or sub-pixel to be increased.

2. The worst case depicted in FIG. 4 is eliminated, thus further increasing the current received by the sub-pixel, minimizing the risk of cross-talk between pixels, and reducing the risk of electrons bombarding the extraction gate.

The emitting surface by pixel is approximately 2.5 times larger for the invention than the prior art. A part of this gain is due to the fact that less space is lost between rows, but most of the increase is due to the fact that each row is used to illuminate two different pixels rows. Thus, regardless of the microtip integration density and the average microtip emissivity, this focusing/deflection mode multiplies the current received by each pixel, and the luminance, by a factor 2.5.

The total power consumption of a FED is the sum of the power dissipated while switching voltages on columns and extraction gate rows, and the anode power. The anode power is the product of the anode voltage by the average current received by the anode. In the focusing/deflection mode, however, there is an extra term due to switching voltages on the second gate rows.

Regardless of the switching sequence, the reactive capacitive power due to switching one of the three systems of electrodes (columns, extraction gate rows or second gate rows) writes: $Rp=C\Delta V^2f$, where C is the total capacitance of the row with other electrodes, $\Delta V$ is the voltage difference between the higher and the lower voltages and f the frequency with which those switches occur. Because of this frequency factor, a one pixel chessboard where columns have to switch between all pixel row illumination time consumes a lot more column power than row power. This chessboard is the worst case for power consumption in an FED.

It is useful to compare the power consumption of FEDs without and with the focusing/deflection mode in a 10.4 inch monochrome VGA screen (480 rows and 640 columns) with a frame rate of 60Hz. It is assumed that the insulator between the columns and the extraction gate and the insulator between the two gates are both one micron thick $SiO_2$ layers. The microtip to extraction gate capacitance is neglected, as well as the intercolumn and inter-row spaces. 50V is switched on gate rows and 30V on columns. With those values, the worst case calculation gives a row power consumption of 0.06W and a column power consumption of 3.1W. Assuming the second anode is not switched, and an average current of 1mA for an anode voltage of 800V, the anode power is 0.8W for a total of 3.96W. For a phosphor efficiency of 2.51 m/W, the luminance of the screen is 2lumens or an overall efficiency of 0.51 m/W.

In the focusing/deflection mode, 150V and 180V are switched on alternate rows and the extra addressing power consumption is 1.86W. Since the current is multiplied by 2.5, the anode power consumption increases to 2W. The total power consumption increases to 7.02W. The luminance of the screen is increased by the same factor to 51 m or an overall efficiency of 0.71 lm/W.

The use of simultaneous focusing and deflection can increase the luminous efficiency of any FED. Moreover, once the anode voltage, the tip packing density and the current per tip have been maximized, this concept still enables the luminance to be multiplied by a factor of 2.5.

The described FED permits the current received by a given pixel to be increased without simultaneously increasing the current density emitted by the cathode novel scanning waveforms. No matter how high the currert density can be raised, the described arrangement allows the total current to be doubled, thus doubling the luminance of the screen.

We claim:

1. A field-emission display (FED) device comprising a cathodoluminescent screen and an emitting assembly for selectively energizing pixels on said screen to form an image, said emitting assembly comprising:

an array of emitters arranged in separately addressable rows; and controllable director means associated with said respective emitters to enable emissions from said emitters in a group of separately addressable addressed rows to be simultaneously directed onto a common energized pixel on said screen.

2. A field-emission display (FED) device as claimed in claim 1, wherein said controllable director means comprise focusing/deflect means overlying said emitters.

3. A field-emission display (FED) device as claimed in claim 1, wherein said array of emitters comprises a plurality of columns of microtip cathodes and a plurality of rows of extraction gates overlying said microtip cathodes, and said focusing/deflection means are provided by said extraction gates to which suitable voltages are applied to deflect said emissions onto said common energized pixel.

4. A field-emission display (FED) device as claimed in claim 2, wherein said array of emitters comprises a plurality of columns of microtip cathodes and a plurality of rows of extraction gates overlying said microtip cathodes, and said focusing/deflection means comprise focusing/deflection gates overlying said respective extraction gates and arranged in rows transverse to said rows of extraction gates or said columns of microtip cathodes.

5. A field-emission display (FED) device as claimed in claim 4, wherein said microtip cathodes are formed on strips of conductive or semiconductive material extending along said columns, and said extraction gates are formed in strips of conductive or semiconductive material extending along said rows of extraction gates.

6. A field-emission display (FED) device as claimed in claim 4, wherein said microtip cathodes and corresponding extraction gates are arranged in groups at the intersection of said columns and said rows of extraction gates.

7. A field-emission display (FED) device as claimed in claim 5, wherein said focusing/deflection gates are formed in strips of conductive or semiconductive material extending over said rows of extraction gates, said focusing/deflection gates overlying said respective extraction gates and spaced therefrom.

8. A field-emission display (FED) device as claimed in claim 7, wherein said focusing/deflection gates have apertures of the same size as their corresponding extraction gates.

9. A field-emission display (FED) device as claimed in claim 7, wherein said focusing/deflection gates have larger apertures than their corresponding extraction gates.

10. A field-emission display (FED) device as claimed in claim 4, wherein said pixels overlap several addressable rows of said emitters.

11. A field-emission display (FED) device as claimed in claim 10, further comprising addressing means for addressing said rows of emitters in groups to permit energization of pixels in rows corresponding to said groups, and control means for controlling said focusing/deflection gates to ensure that the emissions from emitters of all the rows of said addressed group are directed onto corresponding energized pixels.

12. A field-emission display (FED) device as claimed in claim 11, wherein adjacent groups of rows contain common rows so that pixels in adjacent rows can be energized by the same emitters, said control means changing the deflection of said emissions for different groups of emitters to direct said emissions onto the pixels associated with the different groups.

13. A field-emission display (FED) device as claimed in claim 11, wherein said control means comprise means for applying a voltage to said focusing/deflection means to direct emissions from the associated emitters to the desired pixel.

14. A field-emission display (FED) device as claimed in claim 13, wherein said voltage applying means applies a greater negative voltage to the outer rows of an addressed group of rows than the inner rows.

15. A field-emission display (FED) device as claimed in claim 4, wherein said columns of microtip cathodes are sub-divided into sub columns corresponding to respective primary colors.

16. A field-emission display (FED) device as claimed in claim 3, wherein said pixels are arranged in addressable rows to provide an anode switched display.

17. A field-emission display (FED) device as claimed in claim 1, wherein said group of separately addressable rows contains sub-groups of rows having respective common connections.

18. A field-emission display (FED) device as claimed in claim 17, wherein said sub-groups are pairs.

19. A method of displaying an image using, a field-mission display (FED) having an array of emitters arranged in separately addressable rows for energizing pixels on a screen forming an anode, and controllable director means associated with the respective emitters, the method comprising the steps of:

simultaneously addressing a group of separately addressable rows of emitters and activating selected emitters in an addressed group of rows to cause emissions therefrom; and controlling said director means associated with said activated emitters to cause the emissions therefrom to be directed toward common pixels associated with said group of addressed rows.

20. A method as claimed in claim 19, wherein said director means comprise focusing/deflector means.

21. A method as claimed in claim 20, wherein said focusing/deflection means are controlled such that emissions therefrom are directed to an area of the screen representing a pixel which is smaller than the area of the emitters energizing that pixel so as to achieve an increased current density on the anode without incurring increased current density from the emitting assembly.

22. A method as claimed in claim 21, wherein the rows are addressed in such a way that successive addressed groups overlap in a progressive manner such that the same rows are shared with pixels corresponding to different groups of rows, and the focusing/deflection means are controlled so as to direct the emissions onto pixels associated with the active group of rows.

23. A method as claimed in claim 22, wherein said emitters are activated by addressing columns supporting microtip cathodes whereby emitters at the intersections of said energized rows and columns are activated.

24. A method as claimed in claim 23, wherein each row of emitters contains a sub-group of rows of commonly addressed emitters arranged in groups at the intersections of the rows and columns.

25. A method as claimed in claim 24, wherein said focusing/deflection means are arranged in rows overlying said rows of emitters, and said focusing/deflection means are controlled by applying different control voltages thereto so as to direct emissions from the underlying emitters to the activated pixels.

26. A method as claimed in claim 25, wherein a greater negative voltage is applied to the focusing/deflection means of the outer rows than the inner rows of a group of addressed rows.

27. A method as claimed in claim 25, wherein said columns are sub-divided into separately addressable sub-columns corresponding to primary colors so as to support a color image.

28. A method as claimed in claim 19, wherein said simultaneously addressed group of rows contains sub-groups of rows with respective common connections.

* * * * *

UNITED STATES PATENT AND TRADEMARK OFFICE

CERTIFICATE OF CORRECTION

PATENT NO. : 6,069,599
DATED : May 30, 2000
INVENTOR(S) : Christophe Py; Peter Grant It is certified that error appears in the above-indentified patent and that said Letters Patent is hereby corrected as shown below:

Column 1, line 22: "similar to tile one" should be "similar to the one"

Column 9, line 8: "the follow in voltages" should be "the following voltages"

Column 12, lines 3 & 4: "field mission" should be "field-emission"

Signed and Sealed this

Seventeenth Day of April, 2001

*Attest:*

Nicholas P. Godici

NICHOLAS P. GODICI

*Attesting Officer*

*Acting Director of the United States Patent and Trademark Office*